US006030064A

United States Patent [19]

Kim

[11] Patent Number: 6,030,064

[45] Date of Patent: Feb. 29, 2000

[54] REFRIGERATOR WITH REMOVABLE DOOR HINGE

[75] Inventor: Yong Myoung Kim, Suwon, Rep. of Korea

[73] Assignee: Samsung Electronics Co., Ltd., Suwon, Rep. of Korea

[21] Appl. No.: 09/162,064

[22] Filed: Sep. 29, 1998

[30] Foreign Application Priority Data

Sep. 29, 1997 [KR] Rep. of Korea ..... 97-49781

[51] Int. Cl.[7] ..... A47B 96/04

[52] U.S. Cl. ..... 312/405; 312/329; 16/271

[58] Field of Search ..... 312/138.1, 326, 312/329, 401, 405; 16/240, 245, 246, 271

[56] References Cited

U.S. PATENT DOCUMENTS

| | | | |
|---|---|---|---|
| 1,469,525 | 10/1923 | Nadolney | 16/271 |
| 4,785,498 | 11/1988 | Brotschi | 16/240 X |
| 5,040,857 | 8/1991 | Mandel et al. | 312/405 |
| 5,884,366 | 3/1999 | Jeong | 16/271 |

FOREIGN PATENT DOCUMENTS

| | | | |
|---|---|---|---|
| 398963 | 9/1933 | United Kingdom | 16/271 |

*Primary Examiner*—Anthony Knight
*Assistant Examiner*—Karlena D Schwing
*Attorney, Agent, or Firm*—Burns, Doane, Swecker & Mathis, L.L.P.

[57] ABSTRACT

Disclosed is a refrigerator having a hinge member assembled with a door for opening/closing a cooling compartment, and a hinge bracket for supporting the hinge member. The hinge member has a hinge pin assembled on a lower comer of the door, and a pin support part for supporting the hinge pin. The hinge bracket is fixed on a body of the refrigerator, and forms a pocket part for accommodating the hinge member so as to be capable of being pulled out upward therefrom. When the width of the refrigerator has to be narrowed in order to pass the refrigerator through a gate of a room, the door is disassembled and then the hinge member is pulled out from the hinge bracket. Thus, the width of the refrigerator can be narrowed without detaching the hinge bracket from the body, and the damage on the hinge member can be prevented while the refrigerator is conveyed.

8 Claims, 7 Drawing Sheets

REFRIGERATOR WITH REMOVABLE DOOR HINGE

This application claims priority under 35 U.S.C. §§ 119 and/or 365 to Application No. 97-49781, filed in Korea on Sep. 29, 1997, the entire content of which is hereby incorporated by reference.

BACKGROUND OF THE INVENTION

1. Field of the Invention

The present invention relates to a refrigerator, and more particularly, to a refrigerator capable of reducing a width thereof easily by removing a hinge member from a body thereof.

2. Prior Art

FIG. 6 is a front view of a conventional refrigerator. The refrigerator has a body 101 for forming a freezing compartment (not shown) and a fresh food compartment 105 which are partitioned from each other by a partitioning wall and a freezing compartment door 107 and a fresh food compartment door 109 which are respectively installed on front sides of the freezing compartment and the fresh food compartment 105. On both corners of the upper front end part of the body 101, upper hinge brackets 111 protruding frontward are installed, and hinge pins (not shown) protruding downward are formed on the respective upper hinge brackets 111.

At both corners of the lower front end part of the body 101, lower hinge brackets 113 having reversed L-shape substantially are installed. Each of the lower hinge brackets 113 has, as shown in FIG. 7, a fixing part 114 formed with a plurality of screw holes, and a support part 115 extended horizontally from the fixing part 114. A hinge pin 117 protrudes upward from the support part 115, and accommodating recesses 108 for accommodating the hinge pin of the upper hinge bracket 111 and the hinge pin 117 of the lower hinge bracket 113 are respectively formed on the upper and the lower corner area of the fresh food compartment door 109.

Meanwhile, there is a recent tendency that refrigerators become large-sized more and more. There occurs a case that when such a large-sized refrigerator is conveyed, the refrigerator cannot enter a room through a gate of the room since the width thereof is greater than that of the room gate. When such a case occurs, a worker disassembles the doors 107 and 109 of the refrigerator from the body 101 to reduce the width of the refrigerator, and conveys the refrigerator into the room, and then the worker reassembles the doors 107 and 109 with the body 101.

However, in such a conventional refrigerator, since the hinge brackets 111 and 113 protrude from the body 101, even when the doors 107 and 109 are disassembled with the body, the width of the refrigerator is not reduced enough, whereby the hinge brackets 111 and 113 may be hooked by the edge of the gate of the room. Furthermore, in such a situation, the hinge brackets 111 and 113 may undergoes a damage. Therefore, the worker must disassemble the door 107 and 109 from the body 101 as well as the hinge brackets 111 and 113.

However, the hinge brackets 111 and 113, especially the lower hinge bracket 113, are steadfastly fixed on the body 101 by a plurality of screws so that they can support the doors 107 and 109 used for a long period of time while receiving foods to be stored in the refrigerator, the process for assembling and disassembling them is not easy and requires a lot of pains and time.

SUMMARY OF THE INVENTION

The present invention has been proposed to overcome the above-described problems in the prior art, and accordingly it is the object of the present invention to provide a refrigerator having a hinge member capable of being removed easily, thereby reducing the width thereof without disassembling the hinge brackets after disassembling the doors, and facilitating the passage thereof through a gate of a room.

To achieve the above object, the present invention provides a refrigerator having a body for forming a cooling compartment, and a door for opening/closing the cooling compartment, the refrigerator comprising a hinge member having a hinge pin assembled on a corner of the door; and a hinge bracket fixed on the body, the hinge bracket forming a pocket part for accommodating the hinge member so as to be capable of being pulled out therefrom.

Here, the hinge bracket has a front plate part being parallel with a front side of the body, and a flange part formed at an edge of the front plate part, the flange part being fixed on the front side of the body by a plurality of fixing screws.

It is preferable that the front plate part is formed with a plurality of passing holes through which the fixing screws pass. Thus, a worker can easily fix the hinge bracket to the front surface of the refrigerator.

It is more preferable that the hinge bracket has a rib extended toward an inner area of the pocket part, the rib being in contact with the hinge member. The rib functions to guide the insertion of the hinge member into the hinge bracket, and also functions to prevent the free movement of the hinge member when the hinge member is accommodated in the hinge bracket.

Furthermore, the hinge member has a protrusion part protruding downward from a lower end thereof and an accommodation hole for accommodating the protrusion part is formed on a bottom side of the hinge bracket. Accordingly, the hinge member is fixed to a position in the hinge bracket.

Furthermore, the refrigerator further comprises a means for adjusting a height of the hinge member with respect to the hinge bracket. The adjusting means comprises a height adjusting bolt being assembled vertically with a bottom side of the hinge bracket, the height adjusting bolt being contacted with a lower end of the hinge member. The door can be assembled and disassembled more easily by the adjusting means.

According to the present invention, the width of the refrigerator is effectively reduced without disassembling the hinge bracket fixed on the body, and the damage of the hinge member is prevented while the refrigerator is conveyed.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
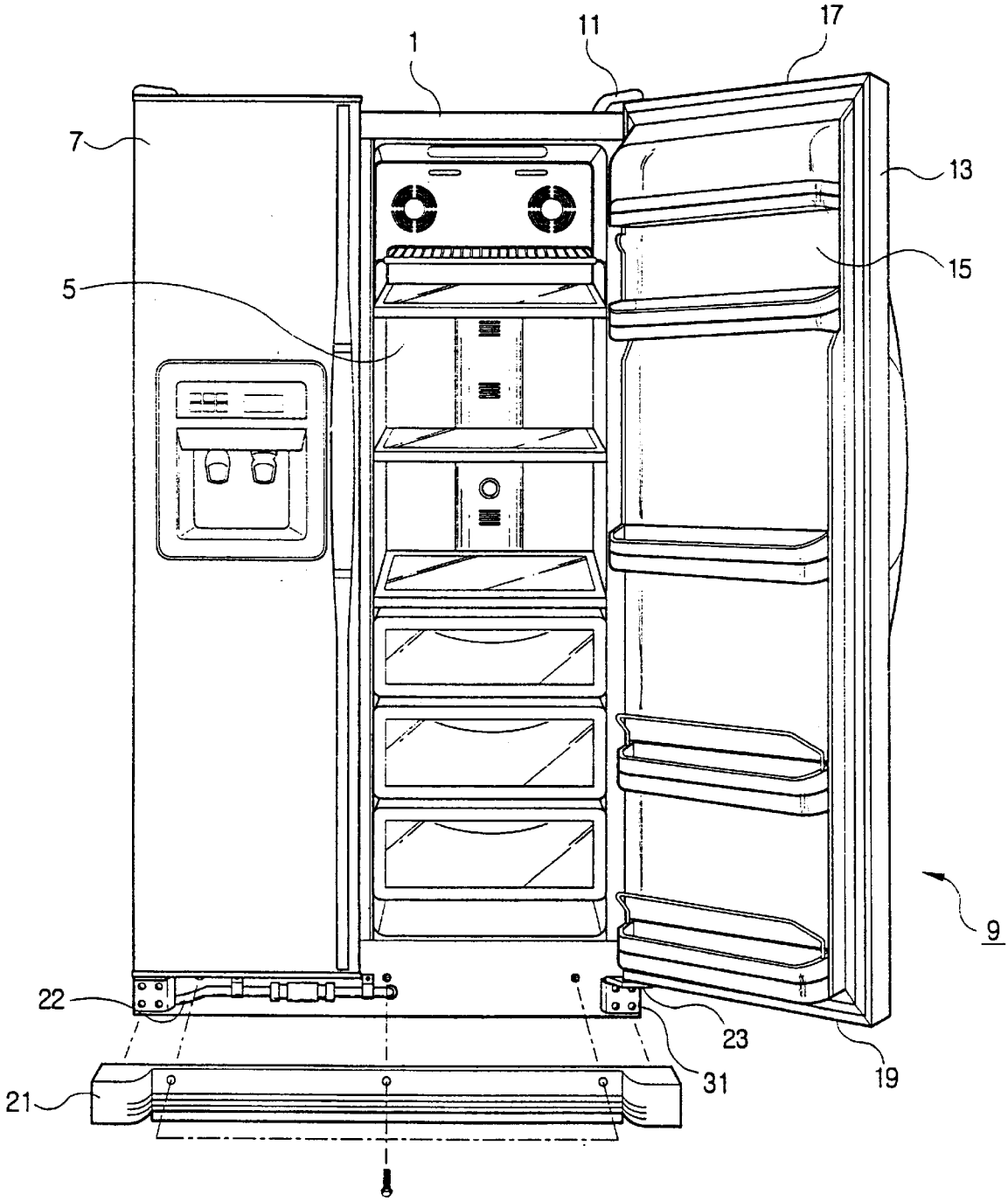
FIG. 1 is a front view of a refrigerator according to the present invention.
Figure 2:
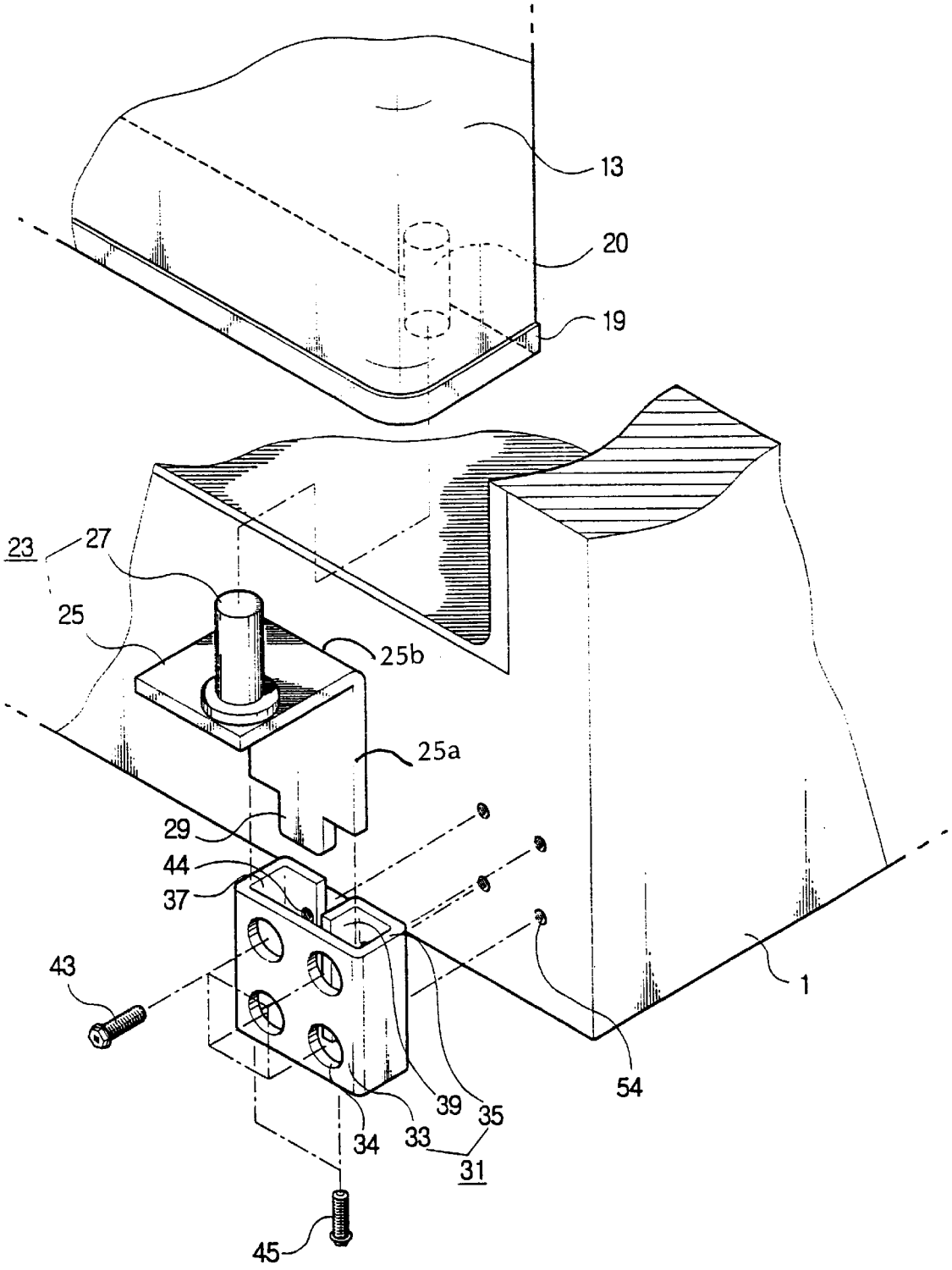
FIG. 2 is an enlarged exploded perspective view of main parts of FIG. 1.
Figure 3:
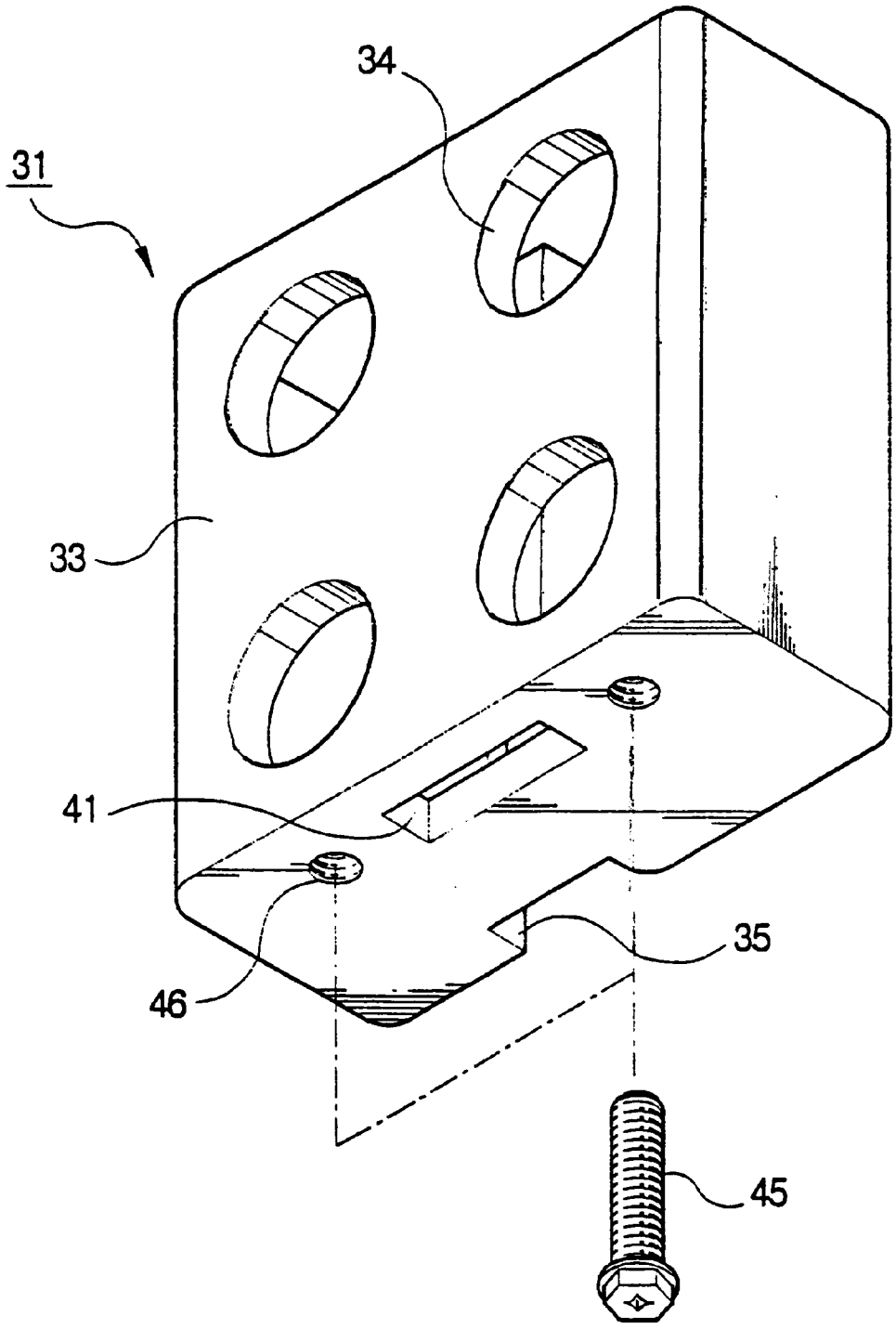
FIG. 3 is an enlarged perspective view showing the bottom side of the hinge bracket shown in FIG. 2.
Figure 4:
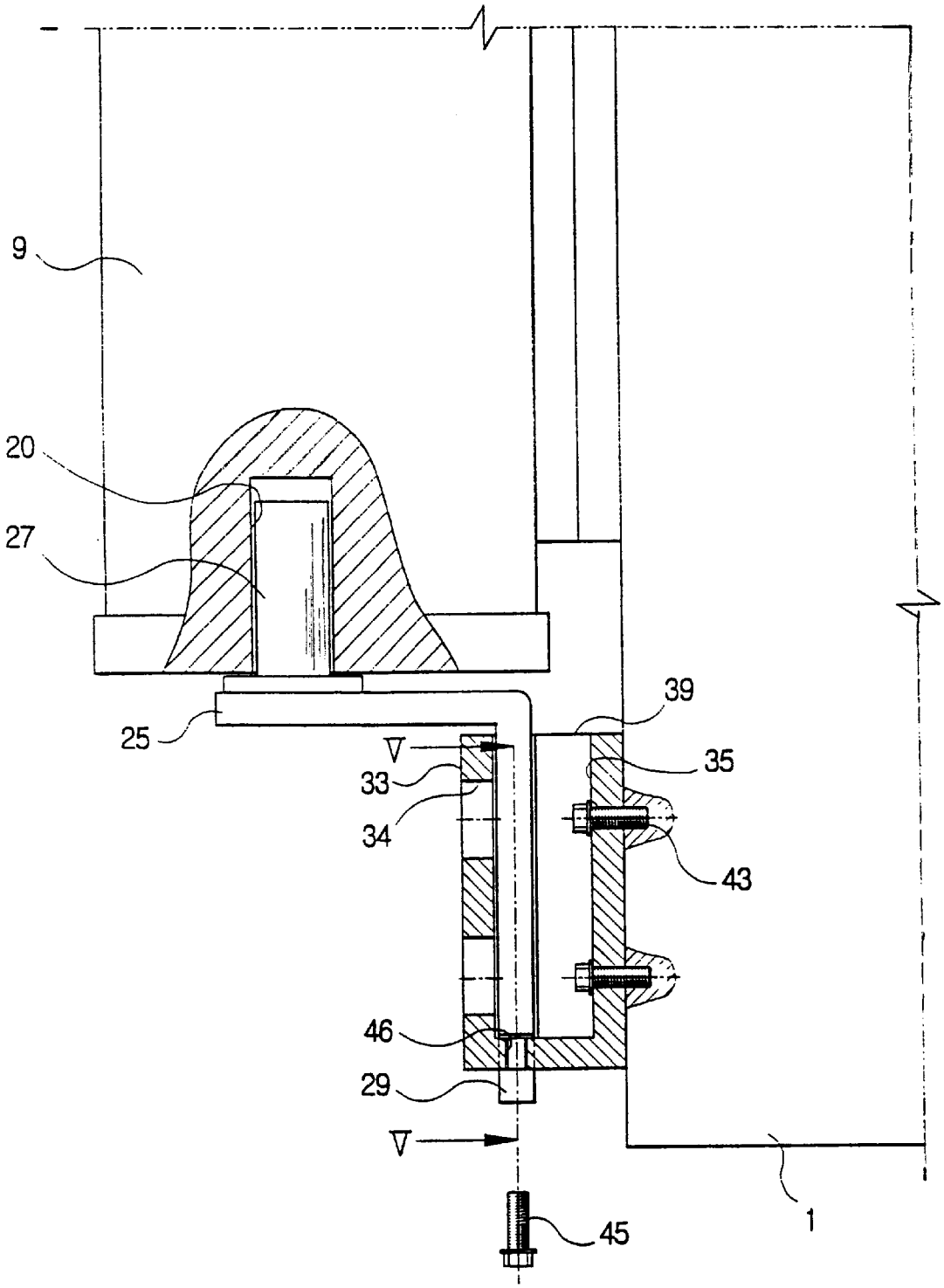
FIG. 4 is a side sectional view of the assembled state of FIG. 2.
Figure 5:
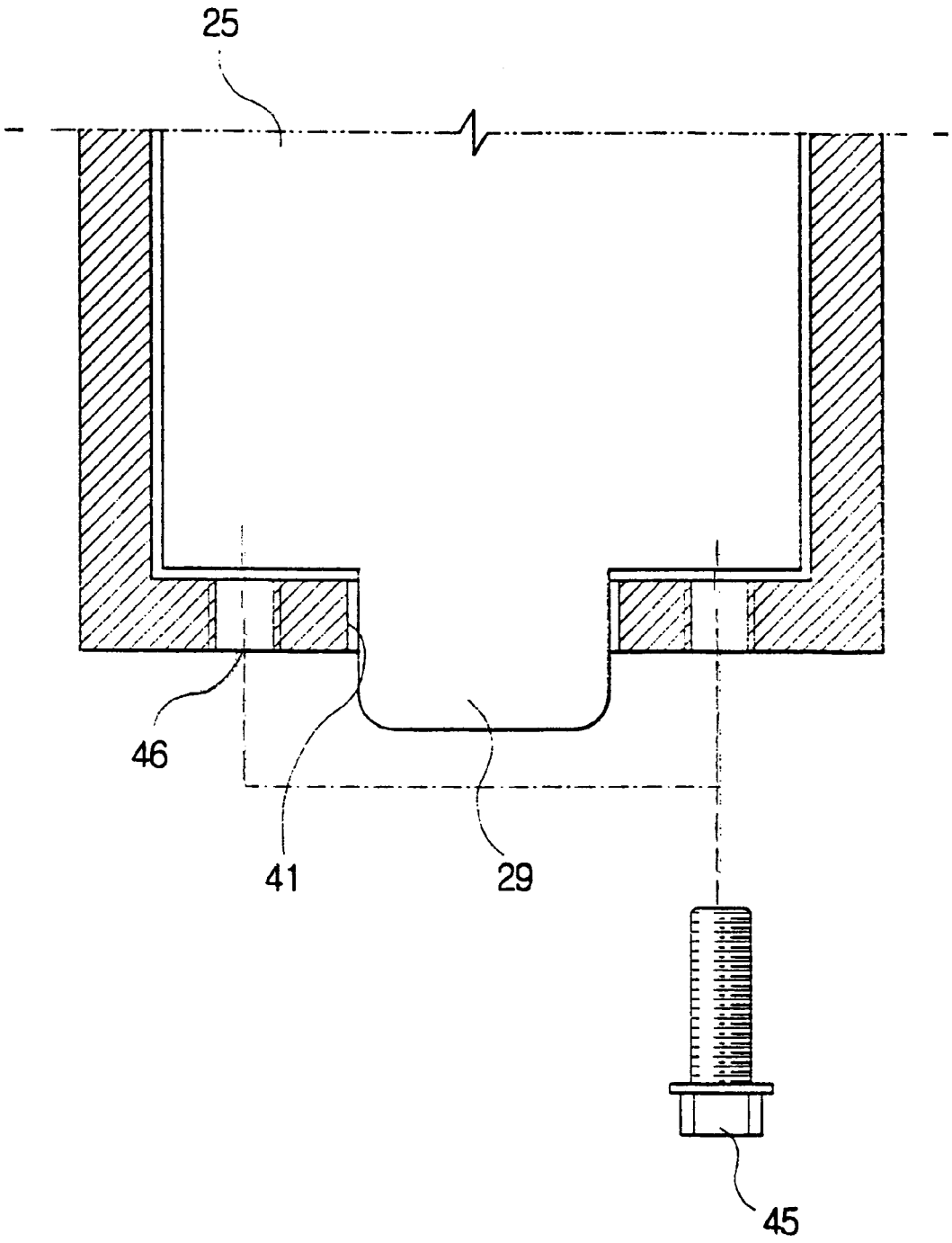
FIG. 5 is a sectional view of FIG. 4 taken along the line I—I.
Figure 6:
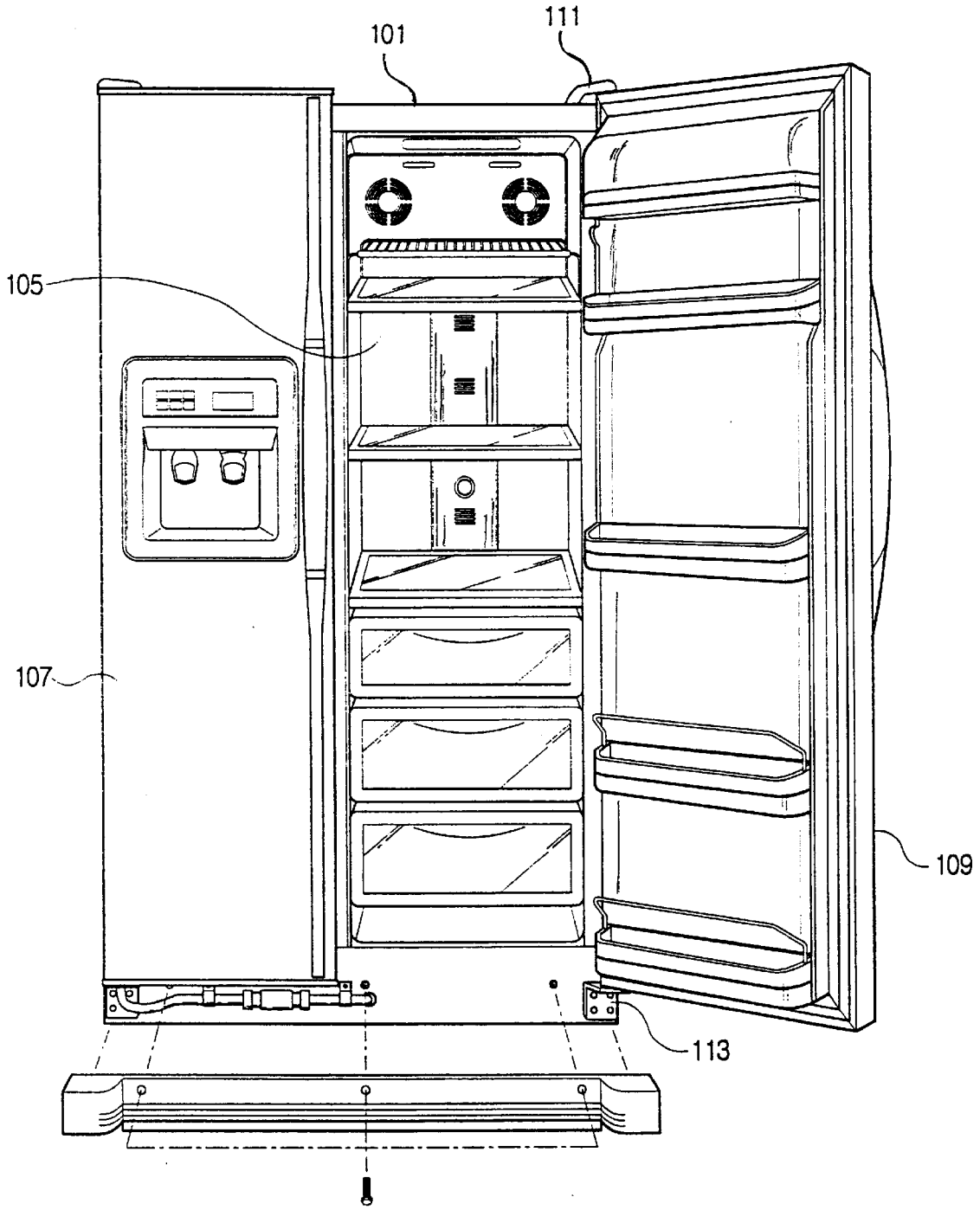
FIG. 6 (PRIOR ART)
FIG. 6 is a front view of a conventional refrigerator.
Figure 7:
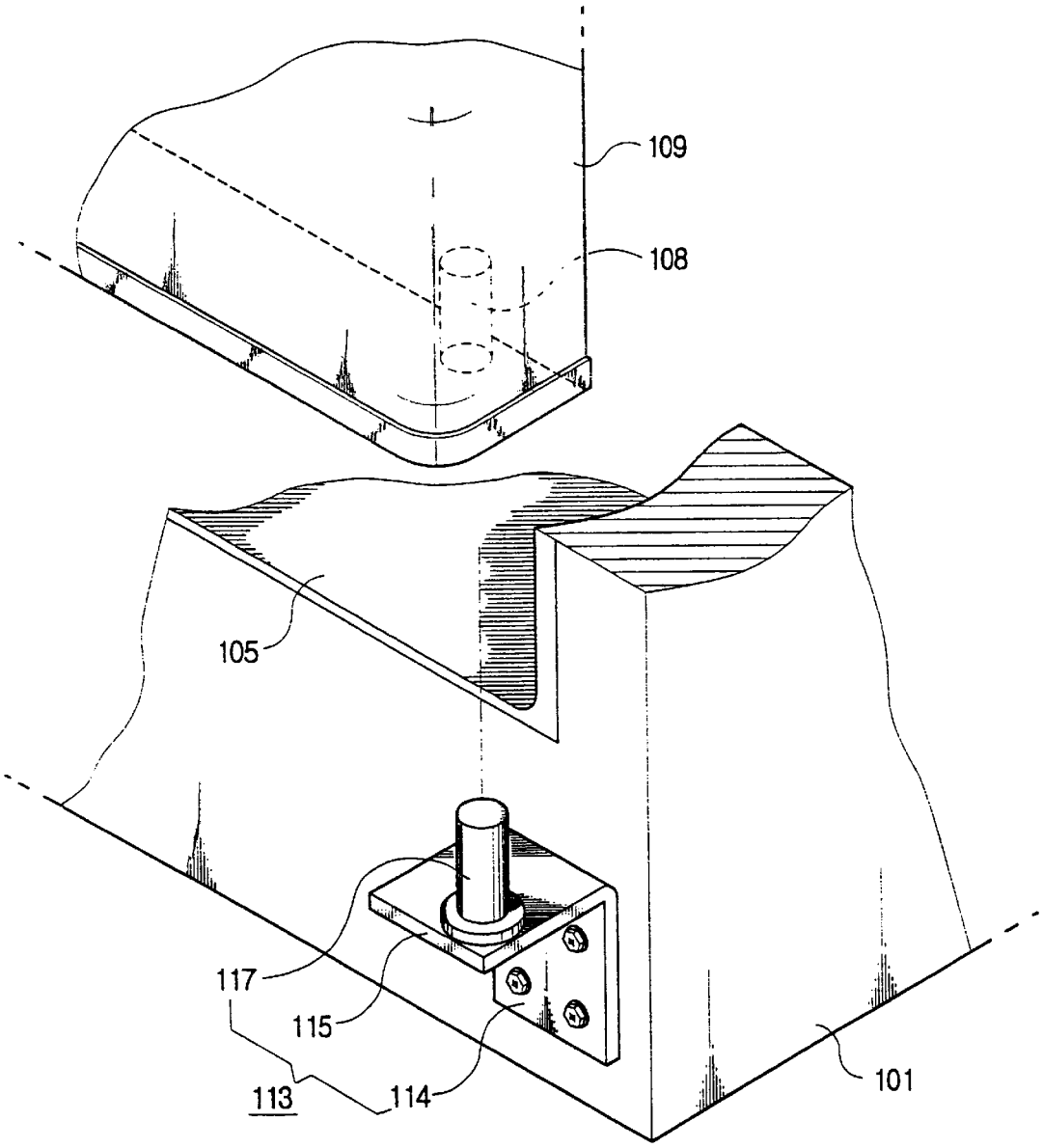
FIG. 7 (PRIOR ART)
FIG. 7 is an enlarged exploded perspective view of main parts of FIG. 6.

FIG. 1 is a front view of a refrigerator according to the present invention, and FIGS. 2 through 5 are views showing the main parts of the refrigerator according to the present invention.

Like the conventional refrigerator, the refrigerator according to the present invention has a body 1 for forming a freezing compartment (not shown) and a fresh food compartment 5 which are partitioned from each other by a partitioning wall, and a freezing compartment door 7 and a fresh food compartment door 9 which are respectively installed on front sides of the freezing compartment and the fresh food compartment 5.

At both corners of the tipper front end pant of the body 1, upper hinge brackets 11 protruding frontward are installed, and hinge pins (not shown) protrude downward from the respective tipper hinge brackets 11.

The fresh food compartment door 9 has an outer plate 13 forming an appearance thereof, an inner plate 15 attached to the inner surface of the outer plate 13, and a pair of door caps 17 and 19 attached to the upper and lower ends of the outer plate 13 and the inner plate 15. The inner space formed by the outer plate 13 and the inner plate 15 is filled up with a heat-insulating material.

Meanwhile, a lower front cover 21 is attached to the lower part of the front side of the body 1, and lower hinge brackets 31 are respectively fixed on both side ends of the lower front part of the body 1. A water supply pipe 22 for supplying water to an ice maker installed in the freezing compartment is installed between the lower hinge brackets 31. Lower hinge members 23 are assembled with the lower hinge brackets 31, respectively.

Each of the lower hinge brackets 23 has a pin support part 25 which is a plate having reversed L-shape substantially, which includes a downwardly extending section 25*a* and a laterally outwardly extending section 25*b*. The hinge bracket 23 further includes a hinge pin 27 protruding upward from the section 25*b*. The pin support part 25 is assembled with the lower binge bracket 31 by being slid downwordly therein freely removal therefrom so as to be capable of being. A protrusion part 29 are formed downward at the lower part of the pin support part 25. The upper part of the pin support part 25 is extended horizontally so as to protrude toward the front of the body 1, and the hinge pin 27 is formed on the upper surface of the extended part.

The lower hinge bracket 31 substantially has the shape of a rectangular tub so that it can accommodate the pin support part 25 of the lower hinge member 23. The lower hinge bracket 31 has a front plate part 33 disposed in parallel with the front side of the body 1, and flange pails 35 formed at both side edges of the front plate pail 33. The flange parts 35 are bent so that the cross section thereof is U-shaped substantially. A pocket 37 is formed by the front plate part 33 and the flange parts 35.

Meanwhile, a plurality of screw holes 44 are formed on the flange parts 35, and fixing holes 54 corresponding to the screw holes 44 are formed at the right lower comer of the front side of the body 1. Furthermore, a plurality of passing holes 34 are provided on the front plate part 33 so that fixing screws 43 can pass therethrough toward the screw holes 44. The fixing screws 43 are assembled with the screw holes 44 and the fixing holes 54 through the passing holes 34, and the lower hinge bracket 31 is steadfastly fixed on the front side of the body 1 by the fixing screws 43.

Furthermore, the flange part 35 is formed with a rib 39. The rib 39 is extended toward the inner space of the pocket 37, and is contacted with the plane of the pin support part 25 while the pin support part 25 is being inserted into the pocket 37, whereby the insertion of the pin support part 25 is guided. Furthermore, the rib 39 functions to prevent the free movement of the pin support part 25 while the pin support part 25 is accommodated in the pocket 37.

Meanwhile, an accommodation hole 41 for accommodating the protrusion part 29 of the pin support part 25 is formed on the central area of the bottom side of the lower hinge bracket 31, and a pair of height adjusting holes 46 are respectively formed at both sides of the accommodation hole 41. Height adjusting bolts 45 are assembled with the height adjusting holes 46, respectively. The upper ends of the height adjusting bolts 45 are respectively contacted with both sides of the lower end of the pin support part 25, and the height of the pin support part 25 is adjusted by the height adjusting bolts 45 with respect to the lower hinge bracket 31.

Hereinbelow, the process for assembling and disassembling the door of the refrigerator according to the present invention having the above-described construction will be described.

A worker positions the lower hinge bracket 31 at the lower right end area of the front side of the body 1, and then assembles the fixing screws 43 to the screw holes 44 and the fixing holes 54, whereby the lower hinge bracket 31 is steadfastly fixed to the front side of the body 1. Then, the worker assembles the lower hinge member 23 with the hinge bracket 31 by inserting the pin support part 25 into the pocket 37. In such a situation, the protrusion part 29 of the pin support part 25 is inserted into the accommodation hole 41, and the lower end of the pin support part 25 is supported by the tipper ends of the height adjusting bolts 45. The downwardly extending section 25*a* of the pin support part is now interposed between the holes 34 and the fastening screws 43.

The worker assembles the fresh food compartment door 9 with the body 1 so that the hinge pin 27 is received by the hinge recess 20 formed at the lower end of the fresh food compartment door 9, and assembles the tipper end of the fresh food compartment door 9 with the upper hinge bracket 11. The worker adjusts the height of the hinge pin 27 with respect to the lower hinge bracket 31 using the height adjusting bolts 45. Then, the assembly of the fresh food compartment door 9 is completed. The freezing compartment door 7 is also assembled easily by the lower hinge bracket 31 and the lower hinge member 23 having the construction identical to those of the fresh food compartment door 9.

If the width of the refrigerator has to be reduced while it is conveyed, the freezing compartment door 7 and the fresh food compartment door 9 are disassembled according to a process reverse to the aforementioned assembly process. In such a situation, after the freezing compartment door 7 and the fresh food compartment door 9 are disassembled, the lower hinge member 23 is freely pulled out upward from the lower hinge bracket 31. Thus, the lower hinge member 23 is easily removed, and the width of the refrigerator is effectively reduced without disassembling the lower hinge bracket 31. Furthermore, the lower hinge member 23 is not damaged while the refrigerator is conveyed.

Moreover, the present embodiment shows the example that the lower hinge member 23 and the hinge bracket 31 according to the present invention are disposed at the lower part of the refrigerator, however, additional hinge member and hinge bracket which have the identical constructions thereto can also be disposed at the upper part of the refrigerator.

As described above, according to the present invention, the width of the refrigerator is effectively reduced without disassembling the hinge bracket fixed on the body, and the damage of the hinge member is prevented while the refrigerator is conveyed.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a body for forming a cooling compartment, and a door for opening/closing said cooling compartment, a lower end of said door forming a downwardly open hinge recess, said refrigerator comprising:

a hinge member having a vertical hinge pin received in the hinge recess, and a pin-support part of reversed L-shape supporting the pin, the pin-support part including a downwardly extending section and a laterally outwardly extending section disposed adjacent an upper end of the downwardly extending section, the pin projecting upwardly from the laterally outwardly extending section; and a hinge bracket fixed on a front side of said body, said hinge bracket forming a pocket freely accommodating said downwardly extending section of said hinge support part whereby said hinge member is capable of being freely pulled out upwardly from said pocket.

2. The refrigerator as claimed in claim 1, wherein said hinge bracket has a front plate part being parallel with and spaced from a front side of said body, and flange parts formed at respective side edges of said front plate part, said flange parts being fixed on the front side of said body by a plurality of fixing screws.

3. The refrigerator as claimed in claim 2, wherein said front plate part is formed with a plurality of through holes through which said fixing screws pass.

4. The refrigerator as claimed in claim 2 wherein said front plate includes a plurality of holes aligned with respective ones of said fixing screws to enable said fastening screws to be inserted through said flange parts, said downwardly extending section of said hinge member being interposed between said holes and said fixing screws when said hinge member is mounted in said hinge bracket.

5. The refrigerator as claimed in claim 1, wherein said hinge bracket has a rib extended toward an inner area of said pocket part, said rib being in contact with said hinge member.

6. The refrigerator as claimed in claim 1, wherein said downwardly extending section has a protrusion part protruding downward from a lower end thereof, and an accommodation hole accommodating said protrusion part is formed in a bottom side of said hinge bracket.

7. The refrigerator as claimed in claim 1, further comprising a means for adjusting a height of said hinge member with respect to said hinge bracket.

8. The refrigerator as claimed in claim 7, wherein said adjusting means comprises a height adjusting bolt being assembled vertically in a bottom side of said hinge bracket, an upper end of said height adjusting bolt being contacted with a lower end of said downwardly extending section.

* * * * *